United States Patent [19]

Sifferman

[11] 4,265,264

[45] May 5, 1981

[54] METHOD OF TRANSPORTING VISCOUS HYDROCARBONS

[75] Inventor: Thomas R. Sifferman, Ponca City, Okla.

[73] Assignee: Conoco, Inc., Ponca City, Okla.

[21] Appl. No.: 35,561

[22] Filed: May 3, 1979

[51] Int. Cl.[3] ..... F17D 1/17

[52] U.S. Cl. ..... 137/13; 252/8.55 R; 252/312

[58] Field of Search ..... 252/8.3, 8.55 R, 312, 252/DIG. 1, 174.21; 137/13

[56] References Cited

U.S. PATENT DOCUMENTS

| | | | |
|---|---|---|---|
| 2,533,878 | 12/1950 | Clark et al. | 137/13 |
| 2,677,700 | 5/1974 | Jackson et al. | 252/357 X |
| 3,380,531 | 4/1968 | McAuliffe et al. | 166/314 |
| 3,382,178 | 5/1968 | Lissant et al. | 252/174.21 X |
| 3,425,429 | 2/1969 | Kane | 137/13 |
| 3,467,195 | 9/1969 | McAuliffe et al. | 166/314 |
| 3,491,835 | 1/1970 | Gagle | 166/305 |
| 3,943,954 | 3/1976 | Flournoy et al. | 137/13 |
| 4,099,537 | 7/1978 | Kalfoglou et al. | 137/13 |

OTHER PUBLICATIONS

Becher, *Emulsions: Theory and Practice,* Second Edition, Pub. 1965 By Reinhold Pub. Corp., pp. 221–223 and 232–234.

"Presenting the Pluronic Grid", Article in *Chemical and Engineering News,* vol. 34, Jan. 30, 1956, pp. 477–480.

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the method comprises adding water containing an effective amount of a combination of (a) a sodium or ammonium salt of an ethoxylated alcohol sulfate and (b) a surfactant selected from the group consisting of certain polyoxyethylene-polyoxypropylene block polymers and certain oxyethylated alcohols. The resulting oil-in-water emulsion has a lower viscosity and is more easily transported.

5 Claims, No Drawings

METHOD OF TRANSPORTING VISCOUS HYDROCARBONS

BACKGROUND OF THE INVENTION

1. Field of the Invention

The invention is in the general field of improved methods of pumping viscous hydrocarbons through a pipe, such as a well-bore or a pipeline.

2. General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

Still another method of moving heavy crudes through pipes uses oil-in-water emulsions which use surfactants to form the emulsions.

U.S. Pat. No. 3,943,954 teaches a method of moving viscous hydrocarbons through a pipe wherein the method uses a solution containing an anionic surfactant or soap such as sodium tridecyl sulfate or sodium oleate together with a guanidine salt and optionally with an alkalinity agent and/or a nonionic surfactant such as polyethoxylated alcohols.

I have found that an aqueous solution of the following materials is effective in reducing the viscosity of viscous hydrocarbons: (a) sodium or ammonium salt of an ethoxylated alcohol sulfate and (b) a surfactant selected from the group consisting of certain polyoxyethylene-polyoxypropylene block polymers and certain oxyethylated alcohols. Surprisingly, combinations of these surfactants provide better results than either material alone.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water containing an effective amount of a combination of (a) a sodium or ammonium salt of an ethoxylated alcohol sulfate and (b) a surfactant selected from the group consisting of certain polyoxyethylene-polyoxypropylene block polymers and certain oxyethylated alcohols.

The precise nature of the materials used will be provided in the detailed description .

DETAILED DESCRIPTION

Insofar as is known my method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. Any water normally found in the proximity of a producing oil-well is suitable.

My invention uses certain specific ethoxylated alcohol sulfates which can be represented by the following structural formula $$[CH_3(CH_2)_xCH_2(OCH_2CH_2)_nOSO_3]M$$

wherein x is an integer in the range of about 8 to about 20, preferably from about 10 to about 16, n is a number in the range of about 1 to about 50, preferably about 2 to about 30, more preferably about 3 to about 12, and M is $NH_4$ or Na, but preferably is sodium.

The alcohol moiety of the ethoxylated alcohol sulfate can be an even or odd number or a mixture thereof. Preferably, the alcohol moiety is an even number. Also, preferably, the alcohol moiety contains 12 to 18 carbon atoms.

Polyoxyethylene-polyoxypropylene block polymers which are used in my invention are represented by one of the following formulae:

$$HO(CH_2CH_2O)_a\,(\overset{\overset{\displaystyle CH_3}{|}}{C}HCH_2O)_b\,(CH_2CH_2O)_cH$$

wherein a and c are numbers in the range of 1 to 15, preferably in the range of 2 to 10, with the sum of a and c being in the range of 2 to 30, preferably 4 to 20, and b is a number in the range of 1 to 32, preferably 6 to 30 or $$HO(\overset{\overset{\displaystyle CH_3}{|}}{C}HCH_2O)_a\,(CH_2CH_2O)_b\,(\overset{\overset{\displaystyle CH_3}{|}}{C}HCH_2O)_cH$$

wherein a and c are numbers in the range of 1 to 16, preferably 3 to about 15, with the sum of a and c being in the range of 2 to 32, preferably 6 to 30, and b is a number in the range of 2 to 30, preferably 4 to 20.

Oxyethylated alcohols which are used in my invention are represented by the formula $$R-(O\overset{\overset{\displaystyle CH_3}{|}}{C}HCH_2)_a\,(CH_2CH_2O)_bH$$

wherein R is an alkyl group, preferably linear, containing 10 to 20, preferably 10 to 18, carbon atoms, a is a number in the range of 1 to 32, preferably 6 to 30, and b is a number in the range of 2 to 30, preferably 4 to 20.

Suitable and preferred amounts of the various surfactants used in my invention, based on the hydrocarbon, are shown below.

| | Suitable- (parts per million) | Preferred |
|---|---|---|
| Sodium or ammonium salt of ethoxylated alcohol sulfate | 25–20,000 | 50–5,000 |
| Polyoxyethylene-polyoxypropylene block polymers | 50–20,000 | 100–5,000 |
| or | | |
| Oxyethylated alcohol | 50–20,000 | 100–5,000 |

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude oil-Goodwin lease crude from Cat Canyon oil field, Santa Maria, Calif.

Water-Goodwin synthetic (Water prepared in laboratory to simulate water produced at the well. It contained 4720 ppm total solids.)

The specific nature of the materials tested will be given in the examples.

Viscosities were determined using a Brookfield viscometer, Model LVT with No. 3 spindle. The procedure is described below.

TEST PROCEDURE

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiplication factor of 200, 100, 40 and 20 for the respective speeds times the dial reading on the viscometer.

It may be well to mention that the final result at 6 RPM is an indication of the stability of the solution being tested.

The difference in viscosity values on the crude alone in the examples is due to the varying amount of water naturally present in the crude. For this reason the viscosity value of the crude alone was obtained in each example. The crude corresponded to that used in combination with the aqueous surfactant.

EXAMPLE 1

This example is comparative and shows the viscosity values obtained on the crude alone and a combination of 50 volume percent crude oil and 50 volume percent water which contained 1,000 parts per million of the sodium salt of a sulfated ethoxylate derived from a $C_{12}$–$C_{14}$ linear primary alcohol blend and containing 3 moles of ethylene oxide.

The results are shown in Table I.

TABLE I

| RPM | Crude Oil Alone (300 ML) Viscosity, cp | Crude Oil Plus 300 ML Goodwin Synthetic Water Containing 1000 ppm of the Described Sulfated Ethoxylate Viscosity, cp |
|---|---|---|
| 6 | 3700 | 100 |
| 12 | 3500 | 200 |
| 30 | 3440 | 152 |
| 60 | Offscale | 100 |
| 30 | 3200 | 200 |
| 12 | 3100 | 450 |
| 6 | 3100 | 880 |
| Test Temperature 88° C. | | Test Temperature 79° C. |

EXAMPLE 2

This example is comparative and shows the viscosity values obtained on the crude alone and a combination of 50 volume percent crude oil and 50 volume percent water which contained 1,000 parts per million of a polyoxyethylene-polyoxypropylene block polymer represented by the formula $$HO(\overset{CH_3}{\overset{|}{C}}HCH_2O)_{12}(CH_2CH_2O)_{23}(\overset{CH_3}{\overset{|}{C}}HCH_2O)_{12}H$$

The results are shown in Table II.

TABLE II

| RPM | Crude Oil Alone (300 ML) Viscosity, cp | Crude Oil Plus 300 ML Goodwin Synthetic Water Containing 1000 ppm of the Described Surfactant Viscosity, cp |
|---|---|---|
| 6 | 3000 | 8000 |
| 12 | 3100 | 7600 |
| 30 | 3080 | Offscale |
| 60 | Offscale | Offscale |
| 30 | 2880 | Offscale |
| 12 | 2800 | 7100 |
| 6 | 2700 | 8800 |
| Test Temperature 88° C. | | Test Temperature 80° C. |

EXAMPLE 3

This example is illustrative and shows the viscosity values obtained on the crude alone and a combination of 50 volume percent crude oil and 50 volume percent water which contained 500 parts per million of the surfactant of Example 1 and 500 parts per million of the surfactant of Example 2.

The results are shown in Table III.

TABLE III

| RPM | Crude Oil Alone (300 ML) Viscosity, cp | Crude Oil Plus 300 ML Goodwin Synthetic Water Containing 500 ppm Surfactant - Example 1 and 500 ppm - Surfactant - Example 2 Viscosity, cp |
|---|---|---|
| 6 | 1900 | 100 |
| 12 | 1750 | 140 |
| 30 | 1760 | 84 |
| 60 | 1700 | 70 |
| 30 | 1560 | 80 |
| 12 | 1500 | 180 |
| 6 | 1500 | 300 |
| Test Temperature 90° C. | | Test Temperature 79° C. |

EXAMPLE 4

This example is illustrative and shows the viscosity values obtained on the crude alone and a combination of 50 volume percent crude oil and 50 volume percent water which contained 333 parts per million of the surfactant of Example 1 and 667 parts per million of the surfactant of Example 2.

The results are shown in Table IV.

TABLE IV

| RPM | Crude Oil Alone (300 ML) Viscosity, cp | Crude Oil Plus 300 ML Goodwin Synthetic Water Containing 333 ppm Surfactant - Example 1 and 667 ppm - Surfactant - Example 2 Viscosity, cp |
|---|---|---|
| 6 | 3600 | 100 |
| 12 | 3450 | 90 |
| 30 | 3360 | 48 |
| 60 | Offscale | 46 |
| 30 | 2960 | 60 |
| 12 | 2900 | 100 |
| 6 | 2900 | 200 |

TABLE IV-continued

| RPM | Crude Oil Alone (300 ML) Viscosity, cp | Crude Oil Plus 300 ML Goodwin Synthetic Water Containing 333 ppm Surfactant - Example 1 and 667 ppm - Surfactant - Example 2 Viscosity, cp |
|---|---|---|
| Test Temperature 88° C. | | Test Temperature 80° C. |

EXAMPLES 5-7

These examples show the synergistic result obtained using a combination of the following:

(a) sodium salt of sulfated ethoxylate of Example 1

(b) an oxyethylated alcohol represented by the formula $$R(O\overset{\overset{CH_3}{|}}{C}HCH_2)_a(CH_2CH_2O)_bH$$

wherein R is a mixture of alkyls containing 12 to 18 carbon atoms, a=6, and b=11

Tests were run using the procedure of the previous examples, (i.e. crude alone and 50/50 crude-water containing specified amount of surfactant).

The tests were run using the following materials and amounts:

Example 5—500 ppm of sulfated ethoxylate

Example 6—500 ppm of the oxyethylated alcohol described above

Example 7

250 ppm—material Example 5

250 ppm—material Example 6

Only the Initial and Final 6 RPM viscosity values are shown.

The results are shown in Table V.

TABLE V

| Example No. | Crude Oil Alone Initial, cp | Crude Oil Alone Final, cp | Crude Oil Plus Surfactant Initial, cp | Crude Oil Plus Surfactant Final, cp |
|---|---|---|---|---|
| 5 | 7000 | 6860 | 700 | 400 |
| 6 | 7400 | 6160 | 15,040 | 14,740 |
| 7 | 8000 | 6700 | 40 | 140 |

EXAMPLES 8-11

These examples show the synergistic results obtained using a combination of the following:

(a) sodium salt of sulfated ethoxylate of Example 1

(b) an oxyethylated alcohol represented by the formula $$R(O\overset{\overset{CH_3}{|}}{C}HCH_2)_a(CH_2CH_2O)_bH$$

wherein R is a mixture of alkyls containing 10 to 12 carbon atoms, a=6, and b=8

Tests were run using the procedure of the previous examples (i.e. crude alone and 50/50 crude-water containing specified amount of surfactant).

The tests were run using the following materials and amounts:

Example 8—500 ppm of sulfated ethoxylate (same as Example 5)

Example 9—500 ppm of the oxyethylated alcohol described above

Example 10

250 ppm—material Example 8

250 ppm—material Example 9

Example 11

167 ppm—material Example 8

333 ppm—material Example 9

Only the Initial and Final 6 RPM viscosity values are shown.

The results are shown in Table VI.

TABLE VI

| Example No. | Crude Oil Alone Initial, cp | Crude Oil Alone Final, cp | Crude Oil Plus Surfactant Initial, cp | Crude Oil Plus Surfactant Final, cp |
|---|---|---|---|---|
| 8 | 7000 | 6860 | 700 | 400 |
| 9 | 6460 | 5100 | 11,000 | 13,800 |
| 10 | 7400 | 6000 | 80 | 60 |
| 11 | 4900 | 4000 | 20 | 20 |

EXAMPLES 12-14

These examples illustrate the synergistic result obtained using a combination of the following:

(a) sodium salt of sulfated ethoxylate of Example 1

(b) a polyoxyethylene-polyoxypropylene block polymer represented by the formula $$HO(CH_2CH_2O)_a(\overset{\overset{CH_3}{|}}{C}HCH_2O)_b(CH_2CH_2O)_cH$$

wherein a=3, b=30, and c=3

Tests were run using the procedure of the previous examples (i.e. crude alone and 50/50 crude-water containing specified amount of surfactant).

The tests were run using the following materials and amounts:

Example 12—500 ppm of sulfated ethoxylate (same as Example 5)

Example 13—500 ppm of the polyoxyethylene-polypropylene block polymer described above Example 14

250 ppm—material Example 12

250 ppm—material Example 13

Only the Initial and Final 6 RPM viscosity values are shown.

The results are shown in Table VII.

TABLE VII

| Example No. | Crude Oil Alone Initial, cp | Crude Oil Alone Final, cp | Crude Oil Plus Surfactant Initial, cp | Crude Oil Plus Surfactant Final, cp |
|---|---|---|---|---|
| 12 | 7000 | 6860 | 700 | 400 |
| 13 | 5200 | 4300 | 12,800 | 13,880 |
| 14 | 8100 | 7200 | 60 | 140 |

Inspection of the data in the preceding examples shows the following:

(a) Use of polyoxyethylene-polyoxypropylene block polymers or the oxyethylated alcohols alone in the water results in an increased viscosity for the emulsion, as compared to the crude.

(b) Use of the sulfated ethoxylate salt alone results in a decrease in viscosity of the emulsion.

(c) Use of the described combination results in an improvement over that obtained with the sulfated ethoxylate salt alone. This is particularly surprising in view of the results obtained using either the polyoxyethylene-polyoxypropylene block polymer or the oxyethoxylated alcohols alone.

Thus, having described the invention in detail, it will be understood by those skilled in the art that certain variations and modifications may be made without departing from the spirit and scope of the invention as defined herein and in the appended claims.

I claim:

1. In the method of transporting a viscous hydrocarbon through a pipe the improvement which comprises forming an oil-in-water emulsion by adding to said hydrocarbon from about 20 to about 80 volume percent of an aqueous solution containing an effective amount of a combination of (a) about 25 to about 20,000 parts per million, based on said hydrocarbon, of a salt of an ethoxylated alcohol sulfate which is represented by the formula $$[CH_3(CH_2)_xCH_2(OCH_2CH_2)_nOSO_3]M$$

wherein x is an integer in the range of about 10 to about 16, n is a number in the range of about 3 to 12, and M is sodium or ammonium, and (b) about 50 to about 20,000 parts per million of a second surfactant selected from the group consisting of (i) materials represented by the formula $$HO(CH_2CH_2O)_a(\overset{\overset{CH_3}{|}}{C}HCH_2O)_b(CH_2CH_2O)_cH, \text{ wherein}$$

a and c are numbers in the range of 2 to 10, with the sum of a and c being in the range of 4 to 20, and b is a number in the range of 6 to 30, (ii) materials represented by the formula $$HO(\overset{\overset{CH_3}{|}}{C}HCH_2O)_a(CH_2CH_2O)_b(\overset{\overset{CH_3}{|}}{C}HCH_2O)_cH, \text{ wherein}$$

a and c are numbers in the range of 3 to 15, with the sum of a and c being in the range of 6 to 30, and b is a number in the range of 4 to 20, and (iii) materials represented by the formula $$R-(O\overset{\overset{CH_3}{|}}{C}HCH_2)_a(CH_2CH_2O)_bH, \text{ wherein}$$

R is a linear alkyl group containing 10 to 18 carbon atoms, a is a number in the range of 6 to 30 and b is a number in the range of 4 to 20.

2. The method of claim 1 wherein, in the ethoxylated alcohol sulfate, M is sodium.

3. The method of claim 2, wherein the amount of aqueous solution is from about 30 to about 60 volume percent.

4. The method of claim 3 wherein the amount of ethoxylated alcohol sulfate is about 50 to about 5,000 parts per million and the amount of the second surfactant is about 100 to about 5,000 parts per million.

5. The method of claim 4 wherein the hydrocarbon is a crude oil.

* * * * *